US005242011A

United States Patent [19]

Hesse

[11] Patent Number: 5,242,011

[45] Date of Patent: Sep. 7, 1993

[54] HEAT EXCHANGER WITH PRESSURE RESPONSIVE BYPASS

[75] Inventor: James L. Hesse, Kenosha, Wis.

[73] Assignee: Thermal Transfer Products, Lt., Racine, Wis.

[21] Appl. No.: 913,163

[22] Filed: Jul. 14, 1992

[51] Int. Cl.[5] ..... F28F 27/02

[52] U.S. Cl. ..... 165/38; 165/103; 165/154; 137/539

[58] Field of Search ..... 165/38, 154, 103; 137/515.5, 539

[56] References Cited

U.S. PATENT DOCUMENTS

| | | | |
|---|---|---|---|
| 1,790,480 | 1/1931 | Macomber et al. | 137/515.5 |
| 1,869,637 | 8/1932 | Walworth | 165/103 |
| 2,372,502 | 3/1945 | Lehane et al. | 165/154 |
| 2,539,669 | 1/1951 | Newcomor et al. | 165/38 |
| 2,809,810 | 10/1957 | Carroll, Jr. et al. | 257/2 |
| 3,877,514 | 4/1975 | Beck | 165/38 |
| 4,209,062 | 6/1980 | Woodhull, Jr. | 165/38 |
| 4,633,939 | 1/1987 | Granetzke | 165/154 |
| 4,991,643 | 2/1991 | Price et al. | 165/38 |

FOREIGN PATENT DOCUMENTS

| | | | |
|---|---|---|---|
| 2826411 | 12/1979 | Fed. Rep. of Germany | 165/38 |
| 813272 | 5/1937 | France | 165/38 |
| 232309 | 4/1925 | United Kingdom | 165/38 |
| 310157 | 4/1929 | United Kingdom | 165/103 |
| 639136 | 6/1950 | United Kingdom | 165/38 |

*Primary Examiner*—John K. Ford
*Attorney, Agent, or Firm*—Arthur J. Hansmann

[57] ABSTRACT

A heat exchanger oil cooler with a bypass valve arrangement for relieving the pressure of the fluid flowing through the heat exchanger tube. The bypass valve arrangement is threadedly connected to the inner tube of a coaxial tube heat exchanger.

19 Claims, 1 Drawing Sheet

HEAT EXCHANGER WITH PRESSURE RESPONSIVE BYPASS

This invention relates to a heat exchanger, more particularly, it relates to a heat exchanger or fluid cooler which includes a bypass valve, and method of making same,

BACKGROUND OF THE INVENTION

Heat exchangers with bypass valves are already known in the prior art, and examples of these are found in U.S. Pat. Nos. 2,809,810 and 3,877,514 and 4,991,643. These prior art heat exchangers all include a bypass valve in a fluid-flow tube which restrains the fluid to flow both around the tube and through the tube, depending upon the fluid pressure exerted within the tube. Where these bypass arrangements are utilized in the exchanger, it is of concern to construct the tube with the bypass valve operative thereon, and to then assemble the tube, or a number of those tubes, in a complete heat exchanger. That is, the prior art arrangements require detailed and elaborate constructions to achieve the assembly and installation of the tube within the heat exchanger beyond the complexity and difficulties in achieving the arrangement, the prior art requires a relatively expensive arrangement in both the manufacture of the parts as well as the assembly of the parts within the final assembly of the exchanger tube. Further, to achieve efficiency of cut-off of the fluid flow in the prior art arrangements, they require expensive and precision type of parts and assembly to accomplish the goals.

Accordingly, it is an object of this invention to provide a heat exchanger or oil cooler or the like wherein the fluid-flow tube has a bypass arrangement which is readily and easily provided in the final assembly of the exchanger and which is inexpensive and yet completely reliable and accurate in preventing the flow through the tube, when that is desired, and to subsequently permit flow through the tube, when that feature is desired. Still further, in accomplishing these objectives, the present invention does so with a minimum of parts, and it provides an arrangement wherein the bypass valve is in an assembly which readily attaches to the end of the tube for achieving the cutoff and subsequently achieve the bypass of the fluid, both as desired.

The present invention provides for a heat exchanger which is efficient in the heat exchange function and which provides for relief of excessive fluid pressures. As such, this exchanger or cooler accommodates cold starts and high viscosity fluids in the bypass process when needed, and it therefore also avoids surges in fluid pressure and is more reliable with regard to avoiding leaking, all because of the bypass feature.

DETAILED DESCRIPTION OF THE PREFERRED EMBODIMENT

Figure 1:
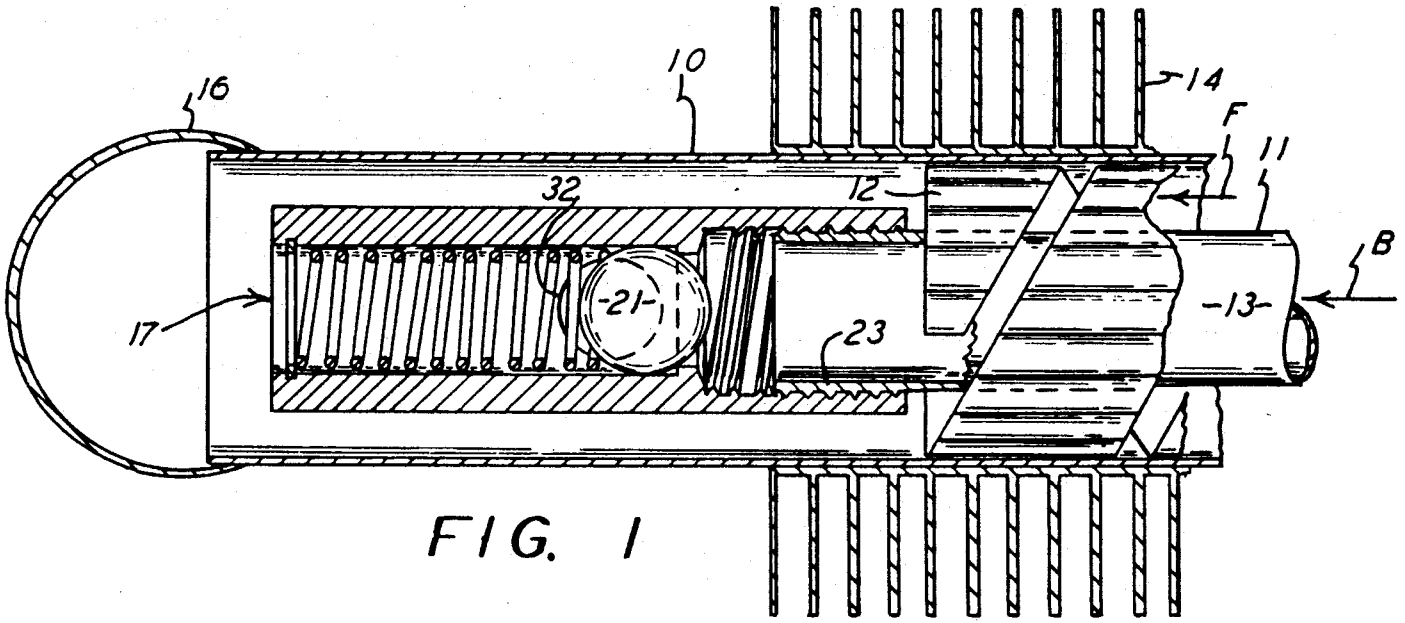
FIG. 1 is a longitudinal sectional view through a preferred embodiment of this invention.

The heat exchanger or cooler of this invention is in the art which is shown in the aforementioned three patents. In those instances, there are two fluid-flow tubes which are co-axial, having one smaller and within the other and with fins extending between the two tubes. FIG. 1 shows a fragment of the entire heat exchanger assembly, and it thus shows the first elongated fluid-flow tube 10 which surrounds the second elongated fluid-flow tube 11, and the tubes 10 and 11 are co-axial, as mentioned. Further, conventional type fins 12 are wrapped around the outer circumference 13 of the inside tube 14, and these fins can be like those shown in U.S. Pat. Nos. 3,877,514 and 4,991,643, for instance. Still further, additional cooling fins 14 extend radially with regard to the outer tube 10, as shown in FIG. 1. Also, there is a fluid-flow manifold 16 which is in fluid-flow connection with the tube 10.

With the understanding of the description to this point, it will be understood by anyone skilled in the art that fluid will flow in the tube 10, such as by the arrow designated F, and that flow will be on the exterior of the tube 11 and across the conventional fins 12. The flow will of course continue through the tube 10 and exteriorly of the tube 11 and flow into the manifold 16.

When the flow of the fluid at the upstream location, that is to the right end of the showing in FIG. 1, is of a pressure of sufficient effort, then the arrangement is such that the flow can also pass through the tube 13 in the direction of the arrow B, and this becomes the bypass flow as hereinafter explained. That bypass flow shown by arrow B will be achieved when the upstream fluid pressure is sufficiently great, and that magnitude can be by virtue of fluid pressure and viscosity and fluid temperature, such as in connection with a liquid fluid such as oil. The flow through tube 11 will be permitted by virtue of the hereinafter described bypass valve which will of course open under a certain pressure condition and thereby allow the flow through the tube 11.

Figure 3:
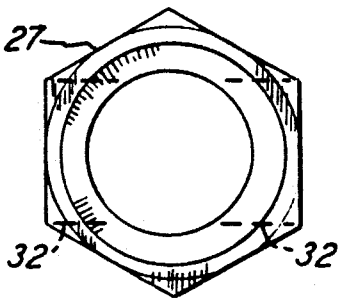
FIG. 3 is an end elevational view of FIG. 2.
Figure 2:
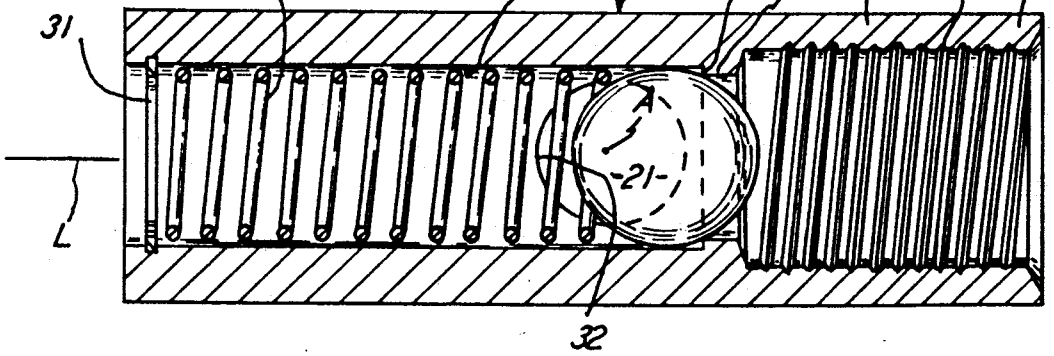
FIG. 2 is an enlarged longitudinal sectional view of a sub-assembly shown in FIG. 1.

FIGS. 1 and 2 show the bypass assembly, generally designated 17, and that assembly is self-contained with regard to a tubular extension 18, a valve seat 19 on the diametrical interior of the extension 18, and a spherical valve closure 21 and a valve closure compression spring 22. The extension assembly 17 has a longitudinal axes designated L which is an extension of the central longitudinal axis of the tube 10. The tubes 10 and the tube 18 of the assembly 17 are readily and easily assembled together by means of turning the assembly 17 onto the end 23 of the tube 11 and by means of the inner threads 24 existing on the end 26 of the extension tube 18. That is, the tube 11 is sufficiently pliable so that the extension 17 can be threaded therealong by means of rotating the assembly 17 such that the threads 24 create the threaded connection between the tubes 11 and 18. FIG. 3 shows that the assembly 17 has hexagonal sides 27 and thus a wrench can be applied to the assembly 17 for the threading process described herein.

With that arrangement, it will now be seen and understood that the sub-assembly 17 is made, in complete form as shown in FIG. 2, and it then can be readily attached to the end 23 of the tube 11, simply by turning the assembly 17 onto the tube end 23, and this makes the desirable co-axial extension which is also fluid tight along the threaded arrangement. The assembly of the sub-assembly 17 on the tube 11 can be accomplished outside the total assembly of the heat exchanger itself, and thus the tube 11 with its extension 17 can then be placed into the exchanger for the final assembly, and no further assembly or work is required relative to providing the bypass valve in the heat exchanger and with that work being performed interiorly of the exchanger itself.

The tube 18 has an annular shoulder portion 28 which presents the annular valve seat 19 around the interior of the tube 18. The valve closure 21 is spherical, and it is of a diameter which is substantially the same as the diameter of the tube 18 at the length designated 29. With that arrangement, the spherical closure 21 can move off the seat 19 but still be aligned with the seat 19 and thus readily move back onto the seat 19 in a secure fluid-sealing relationship. That is, the inner circumference of the length designated 29 is substantially the same as the diameter of the sphere 21 which is therefore in snug and virtual sliding contact with the inner circumference at 29.

The compression spring 22 acts upon the spherical closure 21 to urge it against the seat 19, and a snap ring 31 or the like can retain the compression spring 22 in the tube 18 so that the sub-assembly 17 is complete and secure in and of itself.

Finally, when the spherical closure 21 has fluid pressure applied thereto from the upstream or right-hand side, as viewed in FIGS. 1 and 2, then the closure 21 will move leftwardly and off the seat 19. Depending upon the amount of the pressure and the time over which it is applied, the spherical closure 21 will remain off the annular seat 19 and will permit the pressing fluid to enter a fluid outlet 32 which is only slightly downstream from the valve seat 19 in the cross-sectional relationship through the tube 18. There is an outlet 32 on diametrically opposite sides of the tube 18, as indicated in FIG. 3, and thus fluid which has unseated the closure 21 will readily flow through the two outlets 32 and then into the tube 10 and flow further downstream to the manifold 16.

Again, the arrangement of the spherical closure 21 being of substantially the same diameter as the inner diameter of the inner circumference 29, the outlets 32 are located to be effective when the spherical closure 21 is merely relieved from its closure seat 19. That is, the fluid need not flow past the sphere 21 and out the left-hand end of the tube 18, but, instead, the bypassing fluid will simply flow over the frontal hemispherical surface of the sphere 21 and then immediately enter the outlet openings 32, all as desired for sensitive and instant relief of fluid pressure discussed herein. In that arrangement, the guidance of the sphere 21 is achieved and the instant relief of pressure is also achieved, both as mentioned, by virtue of the fact that the projections axially of the outlets 32 intersect the spherical closure 21 when the closure 21 is in the seated position. In actuality, as viewed in FIGS. 1 and 2, the longitudinal axes of the openings 32, that is transverse on the tube 18 and as designated A in FIG. 2, intersects the sphere 21, all to achieve the sensitive relief of pressure by virtue of the proximity of the openings 32 relative to the spherical closure 21.

The invention herein is the method of constructing the bypass assembly 17 separate and apart from the remainder of the exchanger and to subsequently attach the bypass extension 17 to the exchanger tube 11, as shown in FIG. 1. Further, the assembly of the tube 11 and the extension 17 are then positioned within the tube 10 with its fins 14, and that final assembly is positioned within the completed heat exchanger with a plurality of the assemblies within tube 10 all in a final heat exchanger in the manner which is well understood by anyone skilled in the art and that is as shown in the aforesaid cited U.S. patents herein.

In that method, the bypass valve assembly 17 is formed, as shown in FIG. 2, to have the closure 21 and the valve or closure seat 19 and the compression spring 22 all assembled within the extension tube 18. Also, the threads 24 can be formed on the interior of the tube 18 so that the assembly 17 can be readily and securely attached to the tube 11, as shown in FIG. 1. That is, the sub-assembly 17, when completed, is then attached to a tube 11. In turn, the tube 11 is inserted within the tube 10 which has its fins 14 attached thereto. Finally, a plurality of the assemblies with the tube 10 are disposed in axial parallelism or side-by-side arrangement within a heat exchanger, as is well understood in the prior art, and in that manner the bypass feature can be readily and efficiently provided in the final assembly exchanger. Again, the tube 18 may have its hex sides 27 so that the tube 18 can be readily and securely connected with the tube 11, such as by the threads 24 which self thread onto the tube 11.

What is claimed is:

1. In a heat exchanger of the type having a first tube for the flow of fluid therethrough, a heat exchange fin surrounding said first tube and arranged for the flow of the fluid over said fin, a second tube coaxial with and surrounding said first tube and said fin and being uniformly radially spaced from said first tube for guiding the flow of the fluid over said fin and through the annular space between said tubes, a bypass valve including a valve closure operatively associated with said first tube at the downstream location of the flow of the fluid through said first tube, and said valve including a spring for urging said valve closure against the flow of the fluid and into a valve position to prevent the flow of the fluid through said first tube, the improvement comprising said valve including a tubular member having threads thereon which are threadedly connected to one end of said first tube and presenting a tubular axial end extension of said first tube at the downstream location thereon, said tubular member having means thereon for self-tapping into said first tube in the threaded connection therewith, and with said valve closure and said spring being contained in said tubular member.

2. The heat exchanger as claimed in claim 1, wherein said tubular member has flat sides on the exterior thereof for engagement by a wrench in the threading of said tubular member onto said first tube.

3. The heat exchanger as claimed in claim 1, wherein said tubular member includes an annular valve seat on the interior thereof, and said valve closure is spherical and mates with said valve seat.

4. The heat exchanger as claimed in claim 1, wherein said tubular member has a longitudinal passageway extending along the length of said tubular member, said tubular member having its said threads along one end of said length for threaded connection onto said first tube, said tubular member having an annular valve seat extending around said passageway at an intermediate portion of the length of said tubular member, and said tubular member having a fluid outlet opening therein in fluid flow communication with said passageway at a portion of said tubular member toward the end of said tubular member opposite said one end thereof.

5. The heat exchanger as claimed in claim 4, wherein said valve seat being an annular shoulder extending radially inwardly in said passageway, and said valve closure is a sphere disposed in said passageway and being of a diameter substantially the same as that of said passageway for snug and guided movement is said passageway and being of a diameter larger than that of said annular shoulder for valve-closure seating on said shoulder.

6. The heat exchanger as claimed in claim 5, wherein said tubular member has a fluid-flow outlet opening in fluid-flow communication with said passageway for the flow of fluid from said passageway when said sphere is free of seating on said shoulder.

7. The heat exchanger as claimed in claim 6, wherein said tubular member has flat sides on the exterior thereof for engagement by a wrench in the threading of said tubular member onto said first tube.

8. In a heat exchanger of the type having a first tube for the flow of fluid therethrough, a heat exchange fin surrounding said first tube and arranged for the flow of the fluid over said fin, a second tube coaxial with and surrounding said first tube and said fin and being uniformly radially spaced from said first tube for guiding the flow of the fluid over said fin and through the annular space between said tubes, a bypass valve assembly including a valve closure operatively associated with said first tube at the downstream location of the flow of the fluid through said first tube, and said bypass valve assembly including a spring for urging said valve closure against the flow of the fluid and into a valve closed position to prevent the flow of the fluid through said first tube and for yielding the fluid pressure for allowing an open position of said valve closure and for the flow of fluid past said valve closure, the improvement comprising a tubular member having a circumferential wall, said valve closure and said spring both being contained within said tubular member, said tubular member being threadedly connected to one end of said first tube in the position of a tubular axial extension thereof, said tubular member having a fluid-flow outlet opening in said circumferential wall thereof only at a location downstream from said valve closure for the flow of fluid out of said tubular member outlet when said valve closure is in said open position.

9. The heat exchanger as claimed in claim 8, wherein said tubular member has threads thereon and is thereby threadedly connected to said first tube.

10. The heat exchanger as claimed in claim 8, wherein said tubular member includes an annular valve seat on the interior thereof, and said valve closure is spherical and mates with said valve seat.

11. The heat exchanger as claimed in claim 8, wherein said tubular member has a longitudinal passageway extending along the length of said tubular member, said tubular member having internal threads along one end of said length for threaded connection onto said first tube, said tubular member having an annular valve seat extending around said passageway at an intermediate portion of the length of said tubular member.

12. The heat exchanger as claimed in claim 8, wherein said tubular member has a longitudinal passageway extending along the length of said tubular member, said valve seat being an annular shoulder extending radially inwardly in said passageway, and said valve closure is a sphere disposed in said passageway and being of a diameter substantially the same as that of said passageway for snug and guided movement in said passageway and being of a diameter larger than that of said annular shoulder for valve-closure seating on said shoulder.

13. The heat exchanger as claimed in claim 8, wherein said tubular member has a fluid-flow outlet opening in said circumferential wall only to the downstream side of said valve closure, and said outlet opening has a central axis for the flow of fluid out of said tubular member only at the location downstream from said valve closure, and said valve closure is a sphere and the location of said outlet opening central axis intersects said sphere when said sphere is in said valve closed position.

14. In a heat exchanger of the type having a first tube for the flow of fluid therethrough, a heat exchange fin surrounding said first tube and arranged for the flow of the fluid over said fin, a second tube coaxial with and surrounding said first tube and said fin and being uniformly radially spaced from said first tube for guiding the flow of the fluid over said fin and through the annular space between said tubes, a bypass valve including a valve closure operatively associated with said first tube at the downstream location of the flow of the fluid through said first tube, and said valve including a spring for urging said valve closure against the flow of the fluid and into a valve closed position to prevent the flow of the fluid through said first tube, the improvement comprising said valve including a tubular member connected to one end of said first tube and presenting a tubular axial end extension of said first tube at the downstream location thereon, and with said valve closure and said spring being contained in said tubular member, said tubular member having a longitudinal passageway extending along the length of said tubular member, said tubular member having an annular valve seat including an annular shoulder extending around said passageway at an intermediate portion of the length of said tubular member, and said tubular member having a fluid outlet opening therein in fluid flow communication with said passageway t a portion of said tubular member only to the downstream side of said valve closure.

15. The heat exchanger as claimed in claim 14, wherein said valve closure is a sphere disposed in said passageway and being of a diameter substantially the same as that of said passageway for snug and guided movement in said passageway and being of a diameter larger than that of said annular shoulder for valve-closure seating on said shoulder.

16. The heat exchanger as claimed in claim 14, wherein said tubular member has means thereon for self-tapping into said first tube in the threaded connection therewith.

17. The heat exchanger as claimed in claim 16, wherein said tubular member has flat sides on the exterior thereof for engagement by a wrench in the threading of said tubular member onto said first tube.

18. In a heat exchanger of the type having a first tube for the flow of fluid therethrough, a heat exchange fin surrounding said first tube and arranged for the flow of the fluid over said fin, a second tube coaxial with and surrounding said first tube and said fin and being uniformly radially spaced from said first tube for guiding the flow of the fluid over said fin and through the annular space between said tubes, a bypass valve assembly including a valve closure operatively associated with said first tube at the downstream location of the flow of the fluid through said first tube, and said bypass valve assembly including a spring for urging said valve closure against the flow of the fluid and into a valve closed position to prevent the flow of the fluid through said first tube, the improvement comprising a tubular member, said valve closure and said spring both being contained within said tubular member, said tubular member being threadedly connected to one end of said first tube in the position of a tubular axial extension thereof, said tubular member having a longitudinal passageway extending along the length of said tubular member and having an annular valve seat extending around said passageway at an intermediate portion of the length of said tubular member and said tubular member having a fluid outlet opening therein in fluid flow communication with said passageway at a portion of said tubular member only to the downstream side of said valve closure.

19. In a heat exchanger of the type having a first tube for the flow of fluid therethrough, a heat exchange fin surrounding said first tube and arranged for the flow of the fluid over said fin, a second tube coaxial with and surrounding said first tube and said fin and being uniformly radially spaced from said first tube for guiding the flow of the fluid over said fin and through the annular space between said tubes, a bypass valve assembly including a valve closure operatively associated with said first tube at the downstream location of the flow of the fluid through said first tube, and said bypass valve assembly including a spring for urging said valve closure against the flow of the fluid and into a valve closed position to prevent the flow of the fluid through said first tube, the improvement comprising a tubular member, said valve closure and said spring both being contained within said tubular member, said tubular member being threadedly connected to one ned of said first tube in the position of a tubular axial extension thereof, said tubular member having a longitudinal passageway extending along the length of said tubular member, said valve seat being an annular shoulder extending radially inwardly in said passageway, and said valve closure is a sphere disposed in said passageway and being of a diameter substantially the same as that of said passageway for snug and guided movement in said passageway and being of a diameter larger than that of said annular shoulder for valve-closure seating on said shoulder.

* * * * *